United States Patent [19]

LaPierre et al.

[11] 4,419,220

[45] Dec. 6, 1983

[54] CATALYTIC DEWAXING PROCESS

[75] Inventors: Rene B. LaPierre, Medford; Randall D. Partridge, Princeton; Nai Y. Chen, Titusville, all of N.J.; Steven S. Wong, Langhorne, Pa.

[73] Assignee: Mobil Oil Corporation, New York, N.Y.

[21] Appl. No.: 379,422

[22] Filed: May 18, 1982

[51] Int. Cl.[3] ..... C10G 47/16

[52] U.S. Cl. ..... 208/111; 208/DIG. 2; 208/120; 208/138; 585/481; 585/739; 585/841

[58] Field of Search ..... 208/111, 120, 138; 585/481, 739

[56] References Cited

U.S. PATENT DOCUMENTS

| | | | |
|---|---|---|---|
| 3,308,069 | 3/1967 | Wadlinger et al. | 252/455 Z |
| 3,392,108 | 7/1968 | Mason et al. | 208/111 |
| 3,761,396 | 9/1973 | Pickert | 208/111 |
| 3,764,520 | 10/1973 | Kimberlin et al. | 208/111 |
| 3,894,938 | 7/1975 | Gorring et al. | 208/97 |
| 3,923,641 | 12/1975 | Morrison | 208/111 |
| 4,089,775 | 5/1978 | Berger et al. | 208/111 |
| 4,176,050 | 11/1979 | Chen et al. | 208/111 |
| 4,181,598 | 1/1980 | Gillespie et al. | 208/86 |

FOREIGN PATENT DOCUMENTS 1210335 1/1969 United Kingdom .

*Primary Examiner*—Patrick Garvin
*Assistant Examiner*—George Schmitkons
*Attorney, Agent, or Firm*—Alexander J. McKillop; Michael G. Gilman; Malcolm D. Keen

[57] ABSTRACT

Hydrocarbon feedstocks such as distillate fuel oils and gas oils are dewaxed by isomerizing the waxy components over a zeolite beta catalyst. The process may be carried out in the presence or absence of added hydrogen. Preferred catalysts have a zeolite silica:alumina ratio over 100:1.

10 Claims, No Drawings

CATALYTIC DEWAXING PROCESS

FIELD OF THE INVENTION

This invention relates to a process for dewaxing hydrocarbon oils.

THE PRIOR ART

Processes for dewaxing petroleum distillates have been known for a long time. Dewaxing is, as is well known, required when highly paraffinic oils are to be used in products which need to remain mobile at low temperatures e.g. lubricating oils, heating oils, jet fuels. The higher molecular weight straight chain normal and slightly branched paraffins which are present in oils of this kind are waxes which are the cause of high pour points in the oils and if adequately low pour points are to be obtained, these waxes must be wholly or partly removed. In the past, various solvent removal techniques were used e.g. propane dewaxing, MEK dewaxing, but the decrease in demand for petroleum waxes as such, together with the increased demand for gasoline and distillate fuels, has made it desirable to find processes which not only remove the waxy components but which also convert these components into other materials of higher value. Catalytic dewaxing processes achieve this end by selectively cracking the longer chain n-paraffins, to produce lower molecular weight products which may be removed by distillation. Processes of this kind are described, for example, in The Oil and Gas Journal, Jan. 6, 1975, pages 69 to 73 and U.S. Pat. No. 3,668,113.

In order to obtain the desired selectivity, the catalyst has usually been a zeolite having a pore size which admits the straight chain n-paraffins either alone or with only slightly branched chain paraffins, but which excludes more highly branched materials, cycloaliphatics and aromatics. Zeolites such as ZSM-5, ZSM-11, ZSM-12, ZSM-23, ZSM-35 and ZSM-38 have been proposed for this purpose in dewaxing processes and their use is described in U.S. Pat. Nos. 3,894,938; 4,176,050; 4,181,598; 4,222,855; 4,229,282 and 4,247,388. A dewaxing process employing synthetic offretite is described in U.S. Pat. No. 4,259,174. A hydrocracking process employing zeolite beta as the acidic component is described in U.S. Pat. No. 3,923,641.

Since dewaxing processes of this kind function by means of cracking reactions, a number of useful products become degraded to lower molecular weight materials. For example, olefins and naphthenes may be cracked down to butane, propane, ethane and methane and so may the lighter n-paraffins which do not, in any event, contribute to the waxy nature of the oil. Because these lighter products are generally of lower value than the higher molecular weight materials, it would obviously be desirable to avoid or to limit the degree of cracking which takes place during a catalytic dewaxing process, but to this problem there has as yet been no solution.

Another unit process frequently encountered in petroleum refining is isomerization. In this process, as conventionally operated, low molecular weight $C_4$ to $C_6$ n-paraffins are converted to iso-paraffins in the presence of an acidic catalyst such as aluminum chloride or an acidic zeolite as described in G.B. No. 1,210,335. Isomerization processes for pentane and hexane which operate in the presence of hydrogen have also been proposed but since these processes operate at relatively high temperatures and pressures, the isomerization is accompanied by extensive cracking induced by the acidic catalyst, so that, once more, a substantial proportion of useful products is degraded to less valuable lighter fractions.

SUMMARY OF THE INVENTION

It has now been found that distillate feedstocks may be effectively dewaxed by isomerizing the waxy paraffins without substantial cracking. The isomerization is carried out over zeolite beta as a catalyst and may be conducted either in the presence or absence of added hydrogen. The catalyst should include a hydrogenation component such as platinum or palladium in order to promote the reactions which occur. The hydrogenation component may be used in the absence of added hydrogen to promote certain hydrogenation—dehydrogenation reactions which will take place during the isomerization.

The process is carried out at elevated temperature and pressure. Temperatures will normally be from 250° C. to 500° C. (about 480° F. to 930° F.) and pressures from atmospheric up to 25,000 kPa (3,600 psig). Space velocities will normally be from 0.1 to 20.

DESCRIPTION OF PREFERRED EMBODIMENTS

Feedstock

The present process may be used to dewax a variety of feedstocks ranging from relatively light distillate fractions up to high boiling stocks such as whole crude petroleum, reduced crudes, vacuum tower residua, cycle oils, FCC tower bottoms, gas oils, vacuum gas oils, deasphalted residua and other heavy oils. The feedstock will normally be a $C_{10}+$ feedstock since lighter oils will usually be free of significant quantities of waxy components. However, the process is particularly useful with waxy distillate stocks such as gas oils, kerosenes, jet fuels, lubricating oil stocks, heating oils and other distillate fractions whose pour point and viscosity need to be maintained within certain specification limits. Lubricating oil stocks will generally boil above 230° C. (450° F.), more usually above 315° C. (600° F.). Hydrocracked stocks are a convenient source of stocks of this kind and also of other distillate fractions since they normally contain significant amounts of waxy n-paraffins which have been produced by the removal of polycyclic aromatics. The feedstock for the present process will normally be a $C_{10}+$ feedstock containing paraffins, olefins, naphthenes, aromatics and heterocyclic compounds and with a substantial proportion of higher molecular weight n-paraffins and slightly branched paraffins which contribute to the waxy nature of the feedstock. During the processing, the n-paraffins become isomerized to iso-paraffins and the slightly branched paraffins undergo isomerization to more highly branched aliphatics. At the same time, a measure of cracking does take place so that not only is the pour point reduced by reason of the isomerization of n-paraffins to the less waxy branched chain iso-paraffins but, in addition, the heavy ends undergo some cracking or hydrocracking to form liquid range materials which contribute to a low viscosity product. The degree of cracking which occurs is, however, limited so that the gas yield is reduced, thereby preserving the economic value of the feedstock.

Typical feedstocks include light gas oils, heavy gas oils and reduced crudes boiling above 150° C.

It is a particular advantage of the present process that the isomerization proceeds readily, even in the presence of significant proportions of aromatics in the feedstock and for this reason, feedstocks containing aromatics e.g. 10 percent or more aromatics, may be successfully dewaxed. The aromatic content of the feedstock will depend, of course, upon the nature of the crude employed and upon any preceding processing steps such as hydrocracking which may have acted to alter the original proportion of aromatics in the oil. The aromatic content will normally not exceed 50 percent by weight of the feedstock and more usually will be not more than 10 to 30 percent by weight, with the remainder consisting of paraffins, olefins, naphthenes and heterocyclics. The paraffins content (normal and iso-paraffins) will generally be at least 20 percent by weight, more usually at least 50 or 60 percent by weight. Certain feedstocks such as jet fuel stocks may contain as little as 5 percent paraffins.

Catalyst

The catalyst used in the process comprises zeolite beta, preferably with a hydrogenating component. Zeolite beta is a known zeolite which is described in U.S. Pat. Nos. 3,308,069 and Re 28,341, to which reference is made for further details of this zeolite, its preparation and properties. The composition of zeolite beta in its as synthesized form is as follows; on an anhydrous basis:

$$[XNa(1.0\pm0.1-X)TEA]AlO_2xYSiO_2.$$

where X is less than 1, preferably less than 0.75; TEA represents the tetraethylammonium ion; Y is greater than 5 but less than 100. In the as-synthesized form, water of hydration may also be present in ranging amounts.

The sodium is derived from the synthesis mixture used to prepare the zeolite. This synthesis mixture contains a mixture of the oxides (or of materials whose chemical compositions can be completely represented as mixtures of the oxides) $Na_2O$, $Al_2O_3$, $[(C_2H_5)_4N]_2O$, $SiO_2$ and $H_2O$. The mixture is held at a temperature of about 75° C. to 200° C. until crystallization occurs. The composition of the reaction mixture expressed in terms of mol ratios, preferably falls within the following ranges:

$SiO_2/Al_2O_3$-10 to 200
$Na_2O$/tetraethylammonium hydroxide (TEAOH)-0.0 to 0.1
TEAOH/$SiO_2$-0.1 to 1.0
$H_2O$/TEAOH-20 to 75

The product which crystallizes from the hot reaction mixture is separated, suitably by centrifuging or filtration, washed with water and dried. The material so obtained may be calcined by heating in air on an inert atmosphere at a temperature usually within the range 200° C. to 900° C. or higher. This calcination degrades the tetraethylammonium ions to hydrogen ions and removes the water so that N in the formula above becomes zero or substantially so. The formula of the zeolite is then:

$$[XNa(1.0\pm0.1-X)H].AlO_2.YSiO_2$$

where X and Y have the values ascribed to them above. The degree of hydration is here assumed to be zero, following the calcination.

If this H-form zeolite is subjected to base exchange, the sodium may be replaced by another cation to give a zeolite of the formula (anhydrous basis):

$$[(x/n)M(1\pm0.1-X)H].AlO_2.YSiO_2$$

where X, Y have the values ascribed to them above and n is the valence of the metal M which may be any metal but is preferably a metal of Groups IA, IIA or IIIA of the Periodic Table or a transition metal (the Periodic Table referred to in this specification is the table approved by IUPAC, and the U.S. National Bureau of Standards shown, for example, in the table of Fisher Scientific Company, Catalog No. 5-702-10).

The as-synthesized sodium form of the zeolite may be subjected to base exchange directly without intermediate calcination to give a material of the formula (anhydrous basis):

$$[(x/n)M(1\pm0.1-X)TEA]AlO_2.YSiO_2.$$

where X, Y, n and m are as described above. This form of the zeolite may then be converted partly to the hydrogen form by calcination e.g. at 200° C. to 900° C. or higher. The completely hydrogen form may be made by ammonium exchange followed by calcination in air or an inert atmosphere such as nitrogen. Base exchange may be carried out in the manner disclosed in U.S. Pat. Nos. 3,308,069 and Re. 28,341.

Because tetraethylammonium hydroxide is used in its preparation, zeolite beta may contain occluded tetraethylammonium ions (e.g., as the hydroxide or silicate) within its pores in addition to that required by electroneutrality and indicated in the calculated formulae given in this specification. The formulae, of course, are calculated using one equivalent of cation is required per Al atom in tetrahedral coordination in the crystal lattice.

Zeolite beta, in addition to possessing a composition as defined above, may also be characterized by its X-ray diffraction data which are set out in U.S. Pat. Nos. 3,308,069 and Re. 28,341. The significant d values (Angstroms, radiation: K alpha doublet of copper, Geiger counter spectrometer) are as shown in Table 1 below:

TABLE 1

| d Values of Reflections in Zeolite Beta |
|---|
| 11.40+0.2 |
| 7.40+0.2 |
| 6.70+0.2 |
| 4.25+0.1 |
| 3.97+0.1 |
| 3.00+0.1 |
| 2.20+0.1 |

The preferred forms of zeolite beta for use in the present process are the high silica forms, havng a silica:alumina ratio of at least 30:1. It has been found, in fact, that zeolite beta may be prepared with silica:alumina ratios above the 100:1 maxium specified in U.S. Pat. Nos. 3,308,069 and Re. 28,341 and these forms of the zeolite provide the best performance in the present process. Ratios of at least 50:1 and preferably at least 100:1 or even higher e.g. 250:1, 500:1 may be used in order to maximize the isomerization reactions at the expense of the cracking reactions.

The silica:alumina ratios referred to in this specification are the structural or framework ratios, that is, the ratio fo the $SiO_4$ to the $AlO_4$ tetrahedra which together constitute the structure of which the zeolite is composed. It should be understood that this ratio may vary from the silica:alumina ratio determined by various physical and chemical methods. For example, a gross chemical analysis may include aluminum which is present in the form of cations associated with the acidic sites on the zeolite, thereby giving a low silica:alumina ratio. Similarly, if the ratio is determined by the TGA/$NH_3$ adsorption method, a low ammonia titration may be obtained if cationic aluminum prevents exchange of the ammonium ions onto the acidic sites. These disparities are particularly troublesome when certain treatments such as the dealuminization method described below which result in the presence of ionic aluminum free of the zeolite structure are employed. Due care should therefore be taken to ensure that the framework silica:alumina ratio is correctly determined.

The silica:alumina ratio of the zeolite may be determined by the nature of the starting materials used in its preparation and their quantities relative one to another. Some variation in the ratio may therefore be obtained by changing the relative concentration of the silica precursor relative to the alumina precursor but definite limits in the maximum obtainable silica:alumina ratio of the zeolite may be observed. For zeolite beta this limit is about 100:1 and for ratios above this value, other methods are usually necessary for preparing the desired high silica zeolite. One such method comprises dealumination by extraction with acid and this method is disclosed in detail in U.S. patent application Ser. No. 379,399, filed May 18, 1983, by R. B. LaPierre and S. S. Wong, entitled "High Silica Zeolite Beta", and reference is made to this application for details of the method.

Briefly, the method comprises contacting the zeolite with an acid, preferably a mineral acid such as hydrochloric acid. The dealuminization proceeds readily at ambient and mildly elevated temperatures and occurs with minimal losses in crystallinity, to form high silica forms of zeolite beta with silica:alumina ratios of at least 100:1, with ratios of 200:1 or even higher being readily attainable.

The zeolite is conveniently used in the hydrogen form for the dealuminization process although other cationic forms may also be employed, for example, the sodium form. If these other forms are used, sufficient acid should be employed to allow for the replacement by protons of the original cations in the zeolite. The amount of zeolite in the zeolite/acid mixture should generally be from 5 to 60 percent by weight.

The acid may be a mineral acid, i.e., an inorganic acid or an organic acid. Typical inorganic acids which can be employed include mineral acids such as hydrochloric, sulfuric, nitric and phosphoric acids, peroxydisulfonic acid, dithionic acid, sulfamic acid, peroxymonosulfuric acid, amidodisulfonic acid, nitrosulfonic acid, chlorosulfuric acid, pyrosulfuric acid, and nitrous acid. Representative organic acids which may be used include formic acid, trichloroacetic acid, and trifluoroacetic acid.

The concentration of added acid should be such as not to lower the pH of the reaction mixture to an undesirably low level which could affect the crystallinity of the zeolite undergoing treatment. The acidity which the zeolite can tolerate will depend, at least in part, upon the silica/alumina ratio of the starting material. Generally, it has been found that zeolite beta can withstand concentrated acid without undue loss in crystallinity but as a general guide, the acid will be from 0.1 N to 4.0 N, usually 1 to 2 N. These values hold good regardless of the silica:alumina ratio of the zeolite beta starting material. Stronger acids tend to effect a relatively greater degree of aluminum removal than weaker acids.

The dealuminization reaction proceeds readily at ambient temperatures but mildly elevated temperatures may be employed e.g. up to 100° C. The duration of the extraction will affect the silica:alumina ratio of the product since extraction is time dependent. However, because the zeolite becomes progressively more resistant to loss of crystallinity as the silica:alumina ratio increases i.e. it becomes more stable as the aluminum is removed, higher temperatures and more concentrated acids may be used towards the end of the treatment than at the beginning without the attendant risk of losing crystallinity.

After the extraction treatment, the product is water washed free of impurities, preferably with distilled water, until the effluent wash water has a pH within the approximate range of 5 to 8.

The crystalline dealuminized products obtained by the method of this invention have substantially the same cyrstallographic structure as that of the starting aluminosilicate zeolite but with increased silica:alumina ratios. The formula of the dealuminized zeolite beta will therefore be, on an anhydrous basis:

$$[(x/n)M(1\pm0.1-X)H]AlO_2.YSiO_2$$

where X is less than 1, preferably less than 0.75, Y is at least 100, preferably at least 150 and M is a metal, preferably a transition metal or a metal of Groups IA, 2A or 3A, or a mixture of metals. The silica:alumina ratio, Y, will generally be in the range of 100:1 to 500:1, more usually 150:1 to 300:1, e.g. 200:1 or more. The X-ray diffraction pattern of the dealuminized zeolite will be substantially the same as that of the original zeolite, as set out in Table 1 above. Water of hydration may also be present in varying amounts.

If desired, the zeolite may be steamed prior to acid extraction so as to increase the silica:alumina ratio and render the zeolite more stable to the acid. The steaming may also serve to increase the ease with which the aluminum is removed and to promote the retention of crystallinity during the extraction procedure.

The zeolite is preferably associated with a hydrogenation-dehydrogenation component, regardless of whether hydrogen is added during the isomerization process since the isomerization is believed to proceed by dehydrogenation through an olefinic intermediate which is then dehydrogenated to the isomerized product, both these steps being catalyzed by the hydrogenation component. The hydrogenation component is preferably a noble metal such as platinum, palladium, or another member of the platinum group such as rhodium. Combinations of noble metals such as platinum-rhenium, platinum-palladium, platinum-iridium or platinum-iridium-rhenium together with combinations with non-noble metals, particularly of Groups VIA and VIIIA are of interest, particularly with metals such as cobalt, nickel, vanadium, tungsten, titanium and molybdenum, for example, platinum-tungsten, platinum-nickel or platinum-nickel-tungsten.

The metal may be incorporated into the catalyst by any suitable method such as impregnation or exchange onto the zeolite. The metal may be incorporated in the form of a cationic, anionic or neutral complex such as $Pt(NH_3)_4^{2+}$ and cationic complexes of this type will be found convenient for exchanging metals onto the zeolite. Anionic complexes such as the vanadate or metatungstate ions are useful for impregnating metals into the zeolites.

The amount of the hydrogenation-dehydrogenation component is suitably from 0.01 to 10 percent by weight, normally 0.1 to 5 percent by weight, although this will, of course, vary with the nature of the component, less of the highly active noble metals, particularly platinum, being required than of the less active base metals.

Base metal hydrogenation components such as cobalt, nickel, molybdenum and tungsten may be subjected to a pre-sulfiding treatment with a sulfur-containing gas such as hydrogen sulfide in order to convert the oxide forms of the metal to the corresponding sulfides.

It may be desirable to incorporate the catalyst in another material resistant to the temperature and other conditions employed in the process. Such matrix materials incude synthetic or natural substances as well as inorganic materials such as clay, silica and/or metal oxides. The latter may be either naturally occurring or in the form of gelatinous precipitates or gels including mixtures of silica and metal oxides. Naturally occurring clays which can be composited with the catalyst include those of the montmorillonite and kaolin families. These clays can be used in the raw state as originally mined or initially subjected to calcination, acid treatment or chemical modification.

The catalyst may be composited with a porous matrix material, such as alumina, silica-alumina, silica-magnesia, silica-zirconia, silica-thoria, silica-berylia, silica-titania as well as ternary compositions, such as silica-alumina-thoria, silica-alumina-zirconia, silica-alumina-magnesia, and silica-magnesia-zirconia. The matrix may be in the form of a cogel with the zeolite. The relative proportions of zeolite component and inorganic oxide gel matrix may vary widely with the zeolite content ranging from between 1 to 99, more usually 5 to 80, percent by weight of the composite. The matrix may itself posses catalytic properties, generally of an acidic nature.

Process Conditions

The feedstock is contacted with the zeolite in the presence or absence of added hydrogen at elevated temperature and pressure. The isomerization is preferably conducted in the presence of hydrogen both to reduce catalyst aging and to promote the steps in the isomerization reaction which are thought to proceed from unsaturated intermediates. Temperatures are normally from 250° C. to 500° C. (about 480° F. to 930° F.), preferably 400° C. to 450° C. (750° F. to 840° F.) but temperatures as low as 200° C. may be used for highly paraffinic feedstocks, especially pure paraffins. The use of lower temperatures tends to favor the isomerization reactions over the cracking reactions and therefore the lower temperatures are preferred. Pressures range from atmospheric up to 25,000 kPa (3,600 psig) and although the higher pressures are prefered, practical considerations generally limit the pressure to a maximum of 15,000 kPa (2,160 psig), more usually in the range 4,000 to 10,000 kPa (565 to 1,435 psig). Space velocity (LHSV) is generally from 0.1 to 10 $hr^{-1}$ more usually 0.2 to 5 $hr^{-1}$. If additional hydrogen is present, the hydrogen:feedstock ratio is generally from 200 to 4,000 $n.l.l^{-1}$ (1,125 to 22,470 SCF/bbl), preferably 600 to 2,000 $n.l.l^{-1}$ (3,370 to 11,235 SCF/bbl).

The process may be conducted with the catalyst in a stationary bed, a fixed fluidized bed or with a transport bed, as desired. A simple and therefore preferred configuration is a trickle-bed operation in which the feed is allowed to trickle through a stationary fixed bed, preferably in the presence of hydrogen. With such configuration, it is of considerable importance in order to obtain maximum benefits from this invention to initiate the reaction with fresh catalyst at a relatively low temperature such as 300° C. to 350° C. This temperature is, of course, raised as the catalyst ages, in order to maintain catalytic activity. In general, for lube oil base stocks the run is terminated at an end-of-run temperature of about 450° C., at which time the catalyst may be regenerated by contact at elevated temperature with hydrogen gas, for example, or by burning in air or other oxygen-containing gas.

The present process proceeds mainly by isomerization of the n-paraffins to form branched chain products, with but a minor amount of cracking and the products will contain only a relatively small proportion of gas and light ends up to $C_5$. Because of this, there is less need for removing the light ends which could have an adverse effect on the flash and fire points of the product, as compared to processes using other catalysts. However, since some of these volatile materials will usually be present from cracking reactions, they may be removed by distillation.

The selectivity of the catalyst for isomerization is less marked with the heavier oils. With feedstocks containing a relatively higher proportion of the higher boiling materials relatively more cracking will take place and it may therefore be desirable to vary the reaction conditions accordingly, depending both upon the paraffinic content of the feedstock and upon its boiling range, in order to maximize isomerization relative to other and less desired reactions.

A preliminary hydrotreating step to remove nitrogen and sulfur and to saturate aromatics to naphthenes without substantial boiling range conversion will usually improve catalyst performance and permit lower temperatures, higher space velocities, lower pressures or combinations of these conditions to be employed.

The invention is illustrated by the following examples, in which all percentages are by weight, unless the contrary is stated.

EXAMPLE 1

This Example describes the preparation of high silica zeolite beta.

A sample of zeolite beta in its as synthesized form and having a silica:alumina ratio of 30:1 was calcined in flowing nitrogen at 500° C. for 4 hours, followed by air at the same temperature for 5 hours. The calcined zeolite was then refluxed with 2 N hydrochloric acid at 95° C. for one hour to produce a dealuminized, high silica form of zeolite beta having a silica:alumina ratio of 280:1, an alpha value of 20 and a crystallinity of 80 percent relative to the original, assumed to be 100 percent crystalline. The significance of the alpha value and a method for determining it are described in U.S. Pat. No. 4,016,218 and J. Catalysis, Vol VI, 278–287 (1966), to which reference is made for these details.

For comparison purposes a high silica form of zeolite ZSM-20 was prepared by a combination of steam calcination and acid extraction steps (silica:alumina ratio 250:1, alpha value 10). Dealuminized mordenite with a silica:alumina ratio of 100:1 was prepared by acid extraction of dehydroxylated mordenite.

All the zeolites were exchanged to the ammonium form with 1 N ammonium chloride solution at 90° C. reflux for an hour followed by the exchange with 1 N magnesium chloride solution at 90° C. reflux for an hour. Platinum was introduced into the Beta and ZSM-20 zeolites by ion-exchange of the tetrammine complex at room temperature while palladium was used for the mordenite catalyst. The metal exchanged materials were thoroughly washed and oven dried followed by air calcination at 350° C. for 2 hours. The finished catalysts, which contain 0.6% Pt and 2% Pd by weight, were pelleted, crushed and sized to 30–40 mesh (Tyler) (approx. 0.35 to 0.5 mm) before use.

EXAMPLES 2–3

These Examples illustrate the dewaxing process using zeolite beta.

Two cc of the metal exchanged zeolite beta catalyst were mixed with 2 cc of 30–40 (Tyler) mesh acid washed quartz chips ("Vycor"-trademark) and then loaded into a 10 mm ID stainless steel reactor. The catalyst was reduced in hydrogen at 450° C. for an hour at atmospheric pressure. Prior to the introduction of the liquid feed, the reactor was pressurized with hydrogen to the desired pressure.

The liquid feed used was an Arab light gas oil having the following analysis, by mass spectroscopy:

TABLE 2

| Mass Spectral Analysis of Raw Gas Oil | |
|---|---|
| Hydrocarbon Type | Aromatic Fraction (%) |
| Alkyl Benzenes | 7.88 |
| Diaromatics | 7.45 |
| Triaromatics | 0.75 |
| Tetraaromatics | 0.12 |
| Benzothiophenes | 2.02 |
| Dibenzothiphenes | 0.74 |
| Naphthenebenzenes | 3.65 |
| Dinaphthenebenzenes | 2.73 |
| | Non-Aromatic Fraction (%) |
| Paraffins | 52.0 |
| 1 Ring Naphthenes | 15.5 |
| 2 Ring Naphthenes | 5.4 |
| 3 Ring Naphthenes | 1.4 |
| 4 Ring Naphthenes | 0.5 |
| Monoaromatics | 0.2 |

For comparison, the raw gas oil was hydrotreated over a Co-MO on $Al_2O_3$ catalyst (HT-400) at 370° C., 2 LHSV, 3550 kPa in the presence of 712 n.l.l$^{-1}$ of hydrogen.

The properties of the raw and hydrotreated (HDT) gas oils are shown below in Table 3.

TABLE 3

| Properties of Arab Light Gas Oil | Raw Oil | HDT Oil |
|---|---|---|
| Boiling Range, °C. | 215–380 | 215–380 |
| Sulfur, % | 1.08 | 0.006 |
| Nitrogen, ppm | 53 | 14 |
| Pour Point, °C. | −10 | −10 |

The raw and HDT oils were dewaxed under the conditions shown below in Table 4 to give the products shown in the table. The liquid and gas products were collected at room temperature and atmospheric pressure and the combined gas and liquid recovery gave a material balance of over 95%.

TABLE 4

| Isomerization of Light Gas Oil Over Zeolite Catalyst | Example 2 Raw Feed | Example 3 HDT Feed |
|---|---|---|
| Reaction Pressure, kPa | 6996 | 3550 |
| Temperature, °C. | 402 | 315 |
| LHSV | 1 | 1 |
| Products, percent: | | |
| $C_{1-4}$ | 2.3 | 1.8 |
| $C_5$-165° C. | 16.1 | 16.5 |
| 165° C.+ | 81.6 | 81.7 |
| Total Liquid Product, Pour Point, °C. | −53 | −65 |
| 165° C.+, Pour Point, °C. | −42 | −54 |

The results in Table 3 show that low pour point kerosine products may be obtained in yield of over 80 percent and with the production of only a small proportion of gas, although the selectivity for liquids was slightly lower with the raw oil.

EXAMPLES 4–7

These Examples demonstrate the advantages of zeolite beta in the present process.

The procedure of Examples 2–3 was repeated, using the hydrotreated (HDT) light gas oil as the feedstock and the three catalysts described in Example 1. The reaction conditions and product quantities and characteristics are shown in Table 5 below.

TABLE 5

| Isomerization of HDT Light Gas Oil | Example No. 4 (Pt/Beta) | 5 (Pt/ZSM-20) | 6 (Pt/ZSM-20) | 7 (Pd/Mordenite) |
|---|---|---|---|---|
| Reaction Pressure, kPa | 3550 | 5272 | 10443 | 3550 |
| Temperature, °C. | 315 | 370 | 350 | 315 |
| LHSV | 1 | 1 | 1 | 0.5 |
| Products, percent: | | | | |
| $C_{1-4}$ | 1.8 | 4.6 | 1.4 | 6.8 |
| $C_5$-165° C. | 16.5 | 24.8 | 17.0 | 53.3 |
| 165° C.+ | 81.7 | 70.6 | 81.6 | 39.9 |
| Total Liquid Product, Pour Point, °C. | −65 | −39 | −22 | −42 |

The above results show that at the same yield for 165° C.+ products, the ZSM-20 showed much lower selectivity for isomerization than the zeolite beta and that the mordenite catalyst was even worse.

EXAMPLES 8–10

These Examples illustrate the advantage of zeolite beta in comparison to zeolite ZSM-5.

The procedure of Examples 2–3 was repeated, using the raw light gas oil as the feedstock. The catalyst used was the Pt/Beta (Example 8) or Ni/ZSM-5 containing about 1 percent nickel (Example 9). The results are shown in Table 6 below, including for comparison the results from a sequential catalytic dewaxing/hydrotreating process carried out over Zn/Pd/ZSM-5 (Example 10).

TABLE 6

| Isomerization of Raw Light Gas Oil | Example No. | | |
|---|---|---|---|
| | 8 (Pt/Beta) | 9 (Ni/ZSM-5) | 10 (Zn/Pd/ZSM-5) |
| Reaction Pressure, kPa | 6996 | 5272 | 6996 |
| Temperature, °C. | 402 | 368 | 385 |
| LHSV | 1 | 2 | 2 |
| Products, percent: | | | |
| $C_{1-4}$ | 2.3 | 8.6 | 15.9 |
| $C_5$-165° C. | 16.1 | 11.4 | 19.8 |
| 165° C.+ | 81.6 | 79.1 | 64.3 |
| Total Liquid Product, Pour Point, °C. | −53 | −34 | −54 |

These results show that zeolite beta gives a much lower product pour point than ZSM-5. They show also that zeolite beta gives a much higher 165° C.+ yield and a lower gas yield when compared to a product with a similar pour point but produced by the sequential ZSM-5 catalytic dewaxing/hydrotreating process.

EXAMPLES 11–12

A distillate fuel oil obtained by Thermofor Catalytic Cracking (TCC) having the composition shown in Table 7 below was processed by the same procedure described in Examples 2–3 using the Pt/beta catalyst with the results shown in Table 7 (Example 11). For comparison, the results obtained by cracking the same TCC distillate fuel oil over Ni/ZSM-5 are given also (Example 12).

TABLE 7

| Dexaxing of TCC Distillate Fuel Oil | | Example No. | |
|---|---|---|---|
| | Feed | 11 (Pt/Beta) | 12 (Ni-ZSM-5) |
| $C_{1-4}$ | — | 1.2 | 11.7 |
| $C_5$-165° C. | — | 3.6 | 38.5 |
| 165°–400° C. | 74.1 | 80.9 | 34.0 |
| 400° C.+ | 25.9 | 14.3 | 15.8 |
| 165° C.+ Pour Point, °C. | 43 | −12 | 4 |
| 165° C. KV @ 100° C., cs | 2.48 | 1.95 | 2.62 |

EXAMPLES 13–14

A Minas (Indonesian) heavy gas oil (HVGO) having the properties shown in Table 8 below was passed over a Pt/zeolite beta catalyst ($SiO_2/Al_2O_3$=280; 0.6% Pt) (Example 13) and a NiHZSM-5 catalyst (Example 14) used for comparison purposes. The isomerization conditions and results are shown in Table 9 below.

TABLE 8

| Minas HVGO | |
|---|---|
| Boiling Range, °C. | 340°–540° |
| Gravity, API | 33.0 |
| Hydrogen, percent | 13.6 |
| Sulfur, percent | 0.07 |
| Nitrogen, ppmw | 320 |
| CCR, percent | 0.04 |
| Paraffins, vol. percent | 60 |
| Naphthenes, vol. percent | 23 |
| Aromatics, vol. percent | 17 |
| Pour Point, °C. | 46 |

TABLE 8-continued

| Minas HVGO | |
|---|---|
| KV at 100° C., CS | 4.18 |

TABLE 9

| Dewaxing Minas HVGO | | |
|---|---|---|
| Example No. | 13 | 14 |
| Catalyst | Pt/Beta | NiHZSM-5 |
| Temp, °C. | 450 | 386 |
| Pressure, kPa | 2860 | 2860 |
| LHSV, $hr^{-1}$ | 1.0 | 1.0 |
| $H_2$, n.l.l.$^{-1}$ | 445 | 445 |
| Yields: | | |
| $C_1$–$C_4$ | 3.2 | 13.4 |
| $C_5$-165° C. | 11.6 | 28.9 |
| 165°–340° C. | 31.2 | 5.6 |
| 340° C.+ | 54.0 | 52.1 |
| 340° C.+ Properties: | | |
| Pour Point, °C. | −7 | 10 |
| V. I. | 91 | 77 |
| 340° C.+ Product Analysis; wt. %: | | |
| Paraffins, | 43 | 20 |
| Naphthenes, | 22 | 43 |
| Aromatics, | 35 | 37 |

It can be seen that low pour point 165° C.+ products can be obtained at over 90% yield with very low gas yield. When compared to the cracking over ZSM-5, the high silica beta catalysts gave higher liquid and lower gas yield.

We claim:

1. A process for dewaxing a hydrocarbon feedstock containing straight chain paraffins, which comprises contacting the feedstock with a catalyst comprising zeolite beta having a silica:alumina ratio of at least 30:1 and a hydrogenation component under isomerization conditions.

2. A process according to claim 1 in which the feedstock includes aromatic components in addition to the straight chain paraffins.

3. A process according to claim 2 in which the proportion of aromatic components is from 10 to 50 weight percent of the feedstock.

4. A process according to claim 1 in which the zeolite beta has a silica:alumina ratio over 100:1.

5. A process according to claim 1 in which the zeolite beta has a silica:alumina ratio of at least 250:1.

6. A process according to claim 1 in which the hydrogenation component comprises a noble metal of Group VIIIA of the Periodic Table.

7. A process according to claim 6 in which the hydrogenation component comprises platinum.

8. A process according to claim 1 in which the feedstock is contacted with the catalyst in the absence of added hydrogen.

9. A process according to claim 1 in which the feedstock is contacted with the catalyst in the pressure of hydrogen under isomerization conditions of a temperature from 200° C. to 540° C., a pressure from atmospheric to 25,000 kPa and a space velocity (LHSV) from 0.1 to 20 $hr.^{-1}$.

10. A process according to claim 9 in which the feedstock is contacted with the catalyst in the presence of hydrogen under isomerization conditions of a temperature from 400° C. to 450° C., a pressure from 4,000 to 10,000 kPa and a space velocity (LHSV) from 0.2 to 5 $hr.^{-1}$.

* * * * *

UNITED STATES PATENT AND TRADEMARK OFFICE

CERTIFICATE OF CORRECTION

PATENT NO. : 4,419,220

DATED : December 6, 1983

INVENTOR(S) : Nai Y. CHEN et al

It is certified that error appears in the above—identified patent and that said Letters Patent is hereby corrected as shown below:

Column 2, line 13, after "hydrogenation" insert --/dehydrogenation--.
Column 2, line 15, after "hydrogenation" insert --/dehydrogenation--.
Column 3, line 26, delete "hydrogenating" and insert --hydrogenation/dehydrogenation--.
Column 4, line 62, delete "100:1".
Column 5, line 29, "100:1" should be --200:1--.
Column 6, line 37, delete "Y,"
Column 6, lines 56 & 57, after "hydrogenation" insert --/dehydrogenation--.
Column 6, line 57, after "hydrogenation" insert --/dehydrogenation--.
Column 7, line 17, after "hydrogenation" insert --/dehydrogenation--.
Column 12, claim 6, after "hydrogenation" insert --/dehydrogenation--.
Column 12, claim 7, after "hydrogenation" insert --/dehydrogenation--.

Signed and Sealed this

*Twenty-fourth* Day of *April 1984*

[SEAL]

*Attest:*

GERALD J. MOSSINGHOFF

*Attesting Officer*

*Commissioner of Patents and Trademarks*